US007641494B2

(12) United States Patent
Chen et al.

(10) Patent No.: US 7,641,494 B2
(45) Date of Patent: Jan. 5, 2010

(54) WATERPROOF CONNECTOR AND METHOD FOR MANUFACTURING THE SAME

(75) Inventors: Chang-Nan Chen, Shinjuang (TW); Teng-Sheng Hung, Shinjuang (TW)

(73) Assignee: Liang Tei Co., Ltd., Tainan Hsien (TW)

( * ) Notice: Subject to any disclaimer, the term of this patent is extended or adjusted under 35 U.S.C. 154(b) by 0 days.

(21) Appl. No.: 12/133,592

(22) Filed: Jun. 5, 2008

(65) Prior Publication Data

US 2009/0186506 A1 Jul. 23, 2009

(30) Foreign Application Priority Data

Jan. 23, 2008 (TW) ..... 97102557 A

(51) Int. Cl.
*H01R 13/52* (2006.01)

(52) U.S. Cl. ..... 439/275; 439/606; 439/936; 29/858

(58) Field of Classification Search ..... 439/271, 439/274, 275, 276, 277, 278, 281, 283, 587, 439/588, 589, 606, 936; 29/856, 858
See application file for complete search history.

(56) References Cited

U.S. PATENT DOCUMENTS

| | | | | |
|---|---|---|---|---|
| 4,664,461 | A * | 5/1987 | Schubert et al. | 439/587 |
| 5,637,007 | A * | 6/1997 | Suzuki et al. | 439/276 |
| 5,823,811 | A * | 10/1998 | Blanchfield et al. | 439/274 |
| 6,482,036 | B1 * | 11/2002 | Broussard | 439/606 |
| 6,729,889 | B2 * | 5/2004 | Bauer | 439/67 |
| 6,991,475 | B2 * | 1/2006 | Dreyer et al. | 439/76.1 |
| 7,033,192 | B2 * | 4/2006 | Hansen | 439/181 |
| 2009/0186506 | A1 * | 7/2009 | Chen et al. | 439/281 |

* cited by examiner

*Primary Examiner*—James Harvey
(74) *Attorney, Agent, or Firm*—Chun-Ming Shih

(57) ABSTRACT

In a waterproof connector and a method for the same, the waterproof connector includes a plurality of electrically conductive terminals, an electrically insulating base, an electrical wire, a hollow cylinder and a cladding. The electrically insulating base has a receiving section. The electrical wire has a plurality of cores. Each core is connected to one end of each electrically conductive terminal. The hollow cylinder is connected to the receiving section and located to one side of the electrical wire. The cladding is used to cover the receiving section, the hollow cylinder, the core and one end of electrically conductive terminal. Further, the present invention provides a method for manufacturing the waterproof connector so as to enhance the yield rate and prevent the penetration of moisture.

9 Claims, 11 Drawing Sheets

WATERPROOF CONNECTOR AND METHOD FOR MANUFACTURING THE SAME

BACKGROUND OF THE INVENTION

1. Field of the Invention

The present invention relates to a connector, and in particular to a waterproof connector and a method for manufacturing the same.

2. Description of Prior Art

Modern connectors are widely used in outdoor places. Therefore, there is an increasing demand for waterproof connectors. Most of the connection in the connector is achieved by metals of good electrical conductivity so as to transmit electrical signals. However, these metals may get wet easily to affect the transmission and even get failed. Although some waterproof connectors are available in the market, the waterproof effect thereof is not perfect enough.

FIG. 1 is a schematic view of a conventional connector. A common connector comprises a plurality of electrically conductive terminals 10*a*, an electrically insulating base 20*a*, an electric wire 30*a* and a cladding 40*a*. The right side of the electrically insulating base 20*a* is formed with a receiving section 21*a* and an accommodating trough 22*a* for allowing each of the electrically conductive terminals 10*a* to pass though and be fixed therein. One end of each electrically conductive terminal 10*a* is exposed to the outside of the receiving section 21*a*. The electric wire 30*a* has a plurality of cores. Each of the cores is connected to each electrically conductive terminal 10*a*. The cladding 40*a* is used to cover each of the electrically conductive terminals 10*a*, the electrically insulating base 20*a* and a portion of the electric wire 30*a*. However, such kind of connector has disadvantages as follows. Since the cladding 40*a* is made by means of an injection molding process to cover each electrically conductive terminal 10*a* and the electric wire 30*a*, the cladding 40*a* may hit the connecting portion between each electrically conductive terminal 10*a* and the electric wire 30*a* during the injection of the plastics, which causes poor contact or the breakage in the soldering portions. As a result, the yield rate is reduced. Further, since the electrically insulating base 20*a* made of a hard material and the cladding 40*a* made of a soft material are attached to each other tightly, gaps may be generated between these two materials after being used for a period of time because the difference between the physical properties of these two materials is too large. Thus, moisture may penetrate in the gaps to make the electrically conductive terminals wet, which affects the normal function thereof.

In view of the above problems, the industry of this art has developed another kind of connector. As shown in FIG. 2, a receiving section 21*b* extends from one end of the electrically insulating base 20*b* of the connector. The interior of the receiving section 21*b* is formed with an accommodating trough 22*b*. The soldering portion between each electrically conductive terminal 10*b* and the electrical wire 30*b* is formed in the accommodating trough 22*b*. The receiving section 21*b* acts to protect the soldering portion between each electrically conductive terminal 10*b* and the electrical wire 30*b*. In this way, the cladding 40*b* may not hit the soldering portion directly during the injection of the plastics, so that the electrically conductive terminals 10*b* and the electrical wire 30*b* may not suffer damage. However, such a solution may generate other problems as follows. Since the soldering position between each electrically conductive terminal 10*b* and the electrical wire 30*b* is formed in the accommodating trough 22*b*, it is not easy to solder each electrically conductive terminal 10*b* and the electrical wire 30*b* because the working space is too small. As a result, the yield rate is reduced. Further, if the yield rate of the soldering process is to be increased, the length of each electrically conductive terminal 10*b* should be enlarged to make each electrically conductive terminal 10*b* to protrude from the receiving section 21*b*. However, a long electrically conductive terminal will be bent easily and suffer damage.

Therefore, it is an important issue to provide a waterproof connector to improve the yield rate of production and increase the structural strength of the connector.

SUMMARY OF THE INVENTION

The present invention is to provide a waterproof connector and a method for manufacturing the same. With a hollow cylinder being connected to a receiving section and a cladding covering the receiving section and the hollow cylinder, the conventional problem that the difference between the physical properties of two materials is so large to affect the firm connection of the two materials can be solved. Thus, the external moisture may not penetrate easily, and thus the lifetime can be extended.

The present invention is to provide a waterproof connector and a method for manufacturing the same. The hollow cylinder is connected to the receiving section and covers the connecting portions between the electrically conductive terminals and the cores. During the injection molding process, the plastics will not hot the connecting portions directly, thereby increasing the yield rate of products.

The present invention is to provide a waterproof connector and a method for manufacturing the same. The hollow cylinder and the cladding are made of the same material. Thus, the present invention eliminates the conventional problem occurred in connecting different materials.

The present invention is to provide a waterproof connector and a method for manufacturing the same, whereby a better bending resistance can be obtained even when the length of the electrically insulating base is limited.

The present invention is to provide a waterproof connector, which includes a plurality of electrically conductive terminals, an electrically insulating base, an electrical wire, a hollow cylinder and a cladding. The electrically insulating base allows the electrically conductive terminals to pass through and be fixed therein. The electrically insulating base has a receiving section. The electrical wire has a plurality of cores. The cores are connected to one end of each of the electrically conductive terminals respectively. The hollow cylinder is connected to the receiving section and located to one side of the electrical wire. The cladding is used to cover the receiving section, the hollow cylinder, the core and one end of electrically conductive terminal.

The present invention is to provide a method for manufacturing a waterproof connector, including the steps of:

a) penetrating a plurality of electrically conductive terminals in an electrically insulating base respectively;

b) connecting each core of an electrical wire to one end of each electrically conductive terminal;

c) connecting a hollow cylinder to one end of the electrically insulating base to cover the connecting portions between the electrically conductive terminals and the cores;

d) providing a mold, disposing the semi-finished products made in the steps a) to c) in the mold; and e) injecting a molten cladding in the mold to cover the hollow cylinder and the cores and partially cover the electrically insulating base, the electrically conductive terminals and the electrical wire.

DETAILED DESCRIPTION OF THE INVENTION

The technical contents and detailed description of the present invention will be explained with reference to the accompanying drawings. However, the drawings are illustrative only, but not used to limit the scope of the present invention.

Please refer to FIGS. 3 to 7. The present invention provides a waterproof connector and a method for manufacturing the same, the method includes the following steps.

Figure 1:
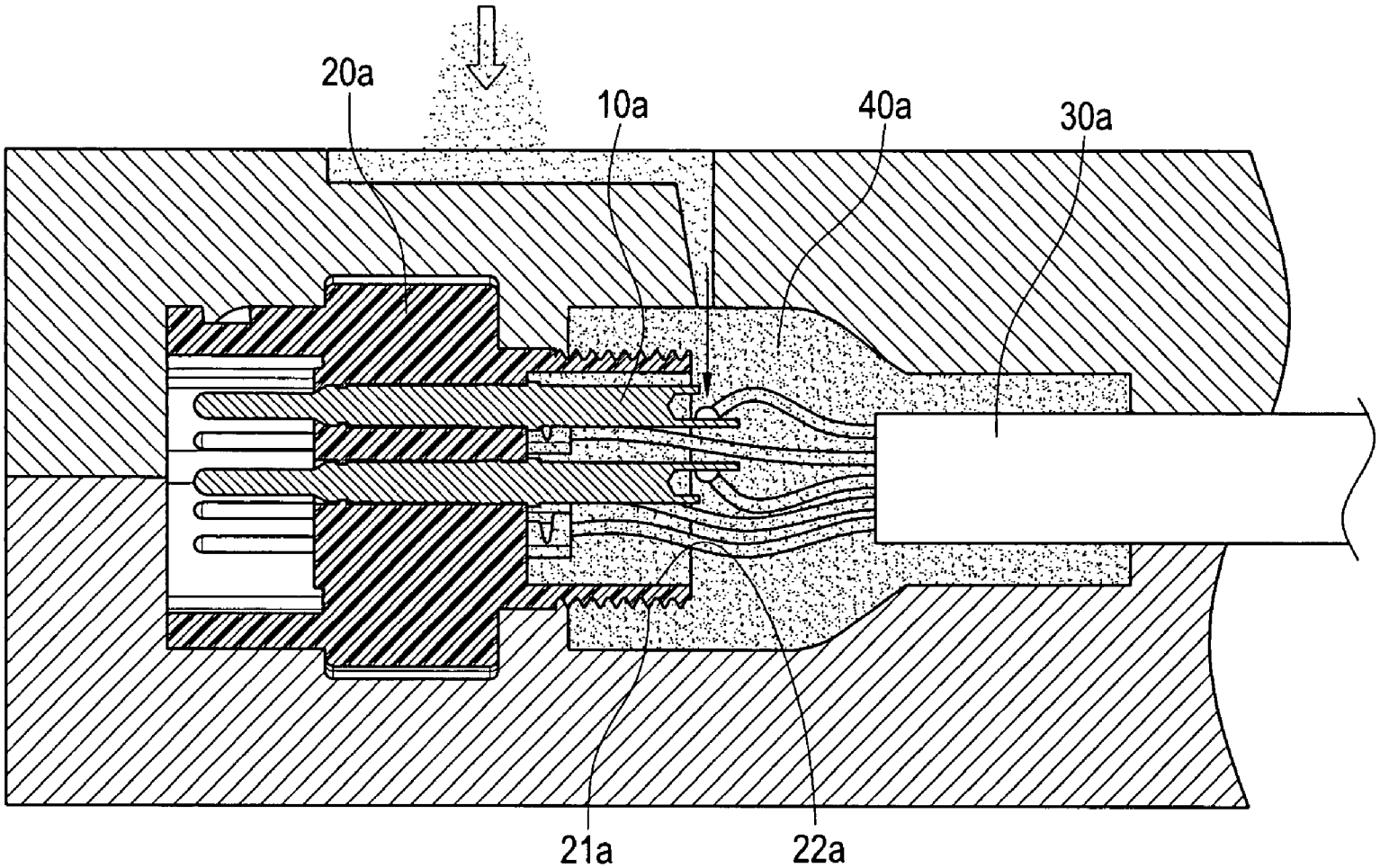
FIG.1 PRIOR ART
FIG. 1 is a schematic view showing a conventional waterproof connector.
Figure 2:
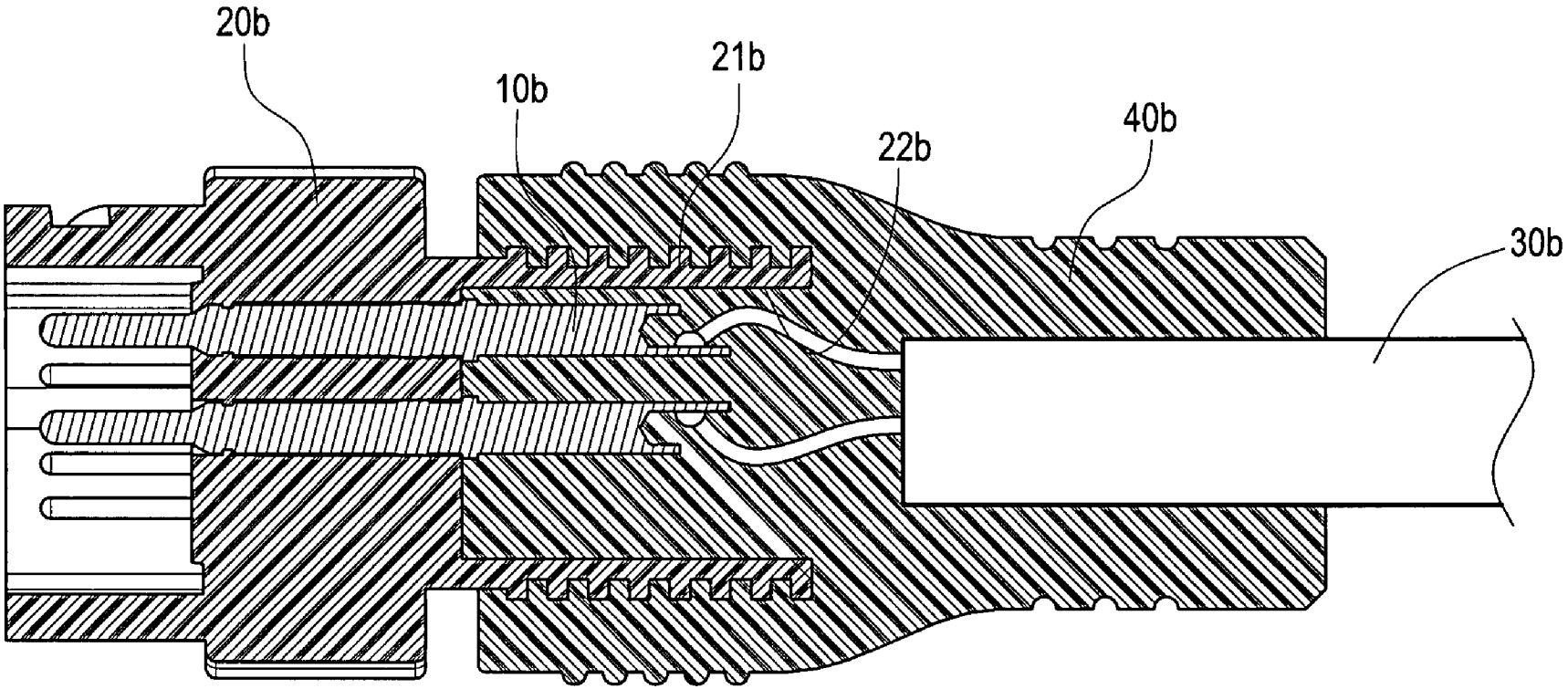
FIG.2 PRIOR ART
FIG. 2 is a cross-sectional view showing another conventional waterproof connector.
Figure 3:
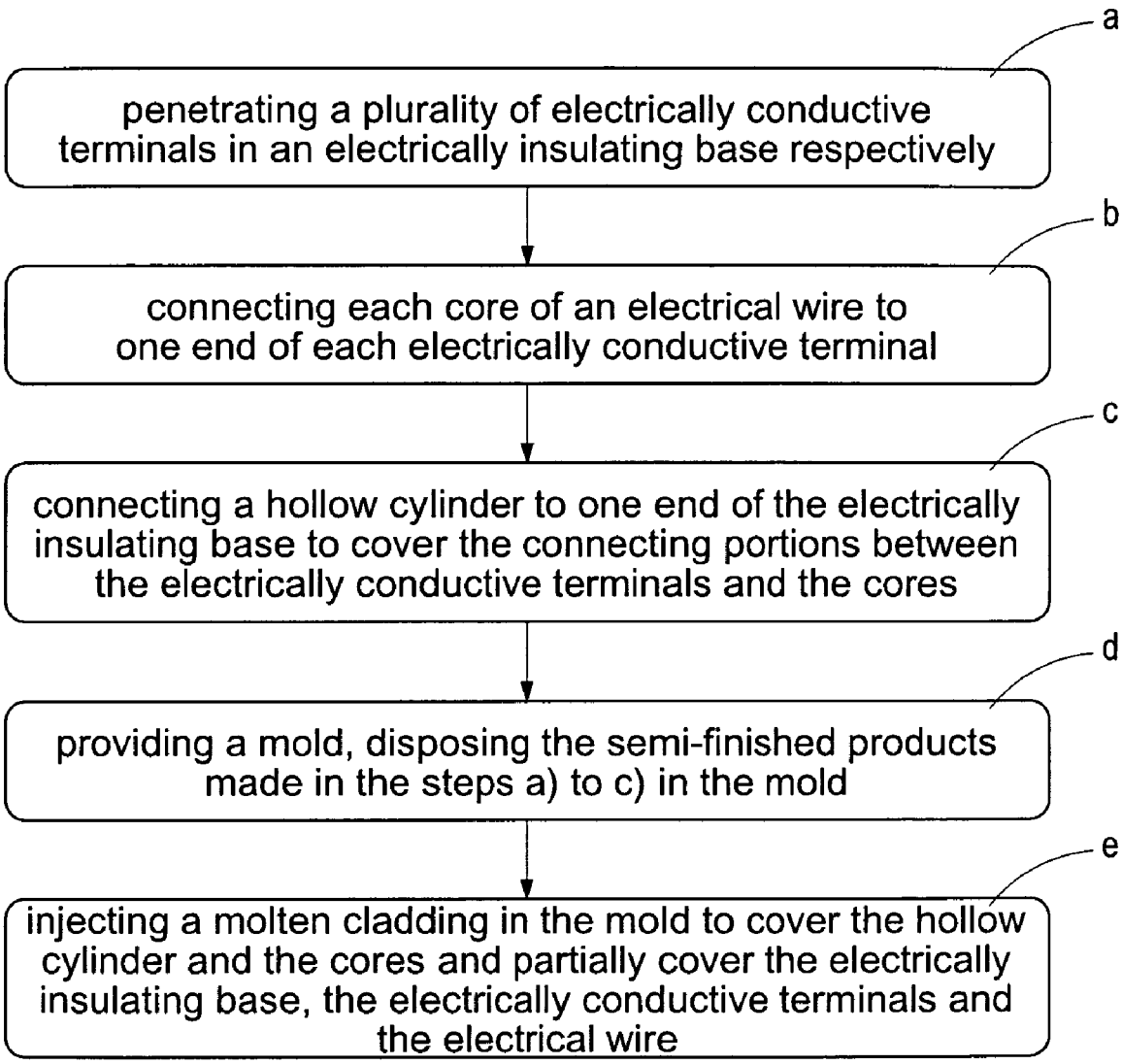
FIG. 3 is a schematic view showing the procedure for manufacturing the present invention.
Figure 4:
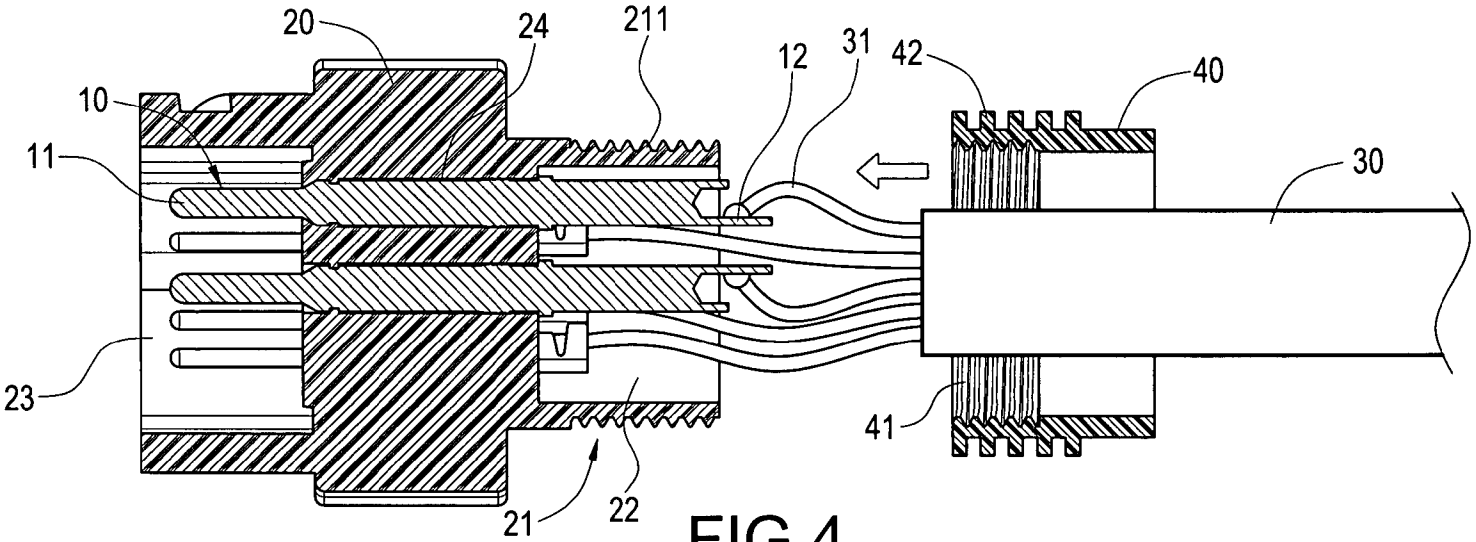
FIG. 4 is a cross-sectional view showing the electrically conductive terminals of the present invention being connected to the electrical wire.

(a) A plurality of electrically conductive terminals 10 penetrates in an electrically insulating base 20 (FIG. 4). In this step, the electrically conductive terminals 10 are made of metals having good electrical conductivity (such as copper). Each electrically conductive terminal has an insertion end 11 and a connecting end 12. In the present embodiment, the connecting end 12 is a soldering end, but it is not limited thereto. The right side of the electrically insulating base 20 is a receiving section 21. The interior of the receiving section 21 is formed with an accommodating trough 22, and the exterior thereof is formed with an first thread 211. In the present embodiment, the first thread is an outer thread, but it is not limited thereto. The left side of the electrically insulating base 20 is formed with an insertion slot 23. The interior of the electrically insulating base 20 is provided with penetrating holes 24 for communicating the accommodating trough 22 and the insertion slot 23. In manufacturing, the electrically conductive terminals 10 are inserted in the penetrating holes 24 and fixed thereto respectively. As a result, the insertion end 11 is accommodated in the insertion slot 23 while the connecting end 12 is partially exposed to the outside of the receiving section 21.

(b) Each core 31 of an electrical wire 30 is connected to one end of each of the electrically conductive terminals 10 (FIG. 4). In this step, each core 31 of the electrical wire 30 is connected to the connecting end 12 of each electrically conductive terminal 10 by means of soldering.

Figure 5:
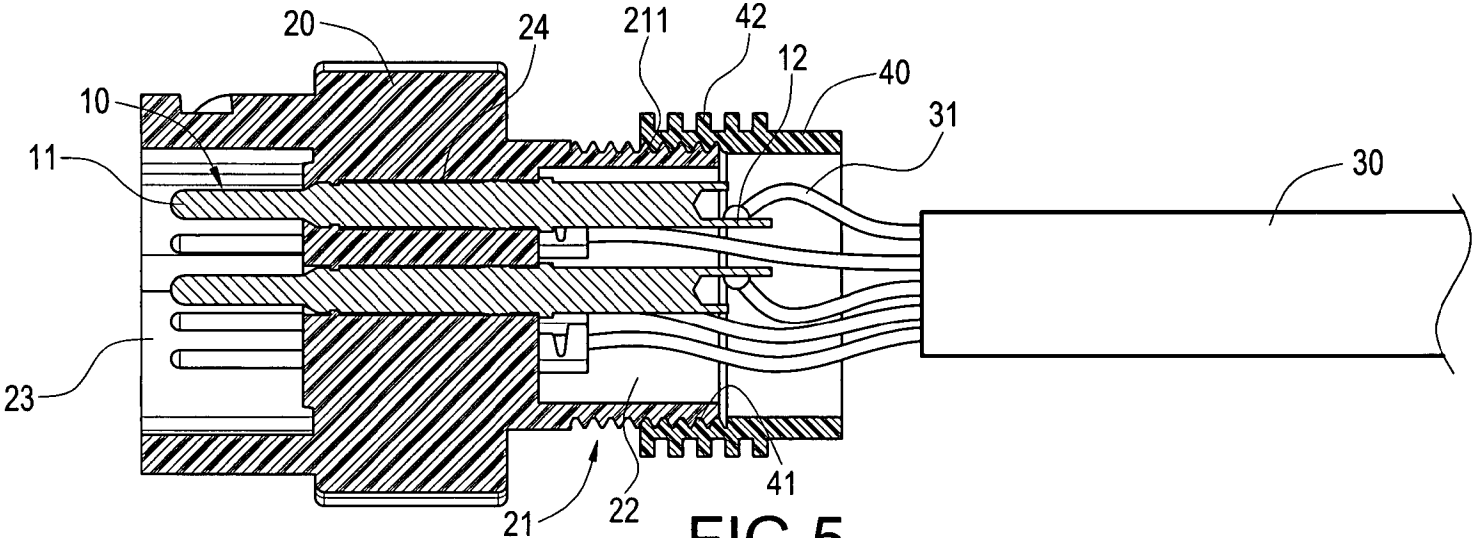
FIG. 5 is a cross-sectional view showing the hollow cylinder of the present invention being connected to the electrically insulating base.
Figure 8:
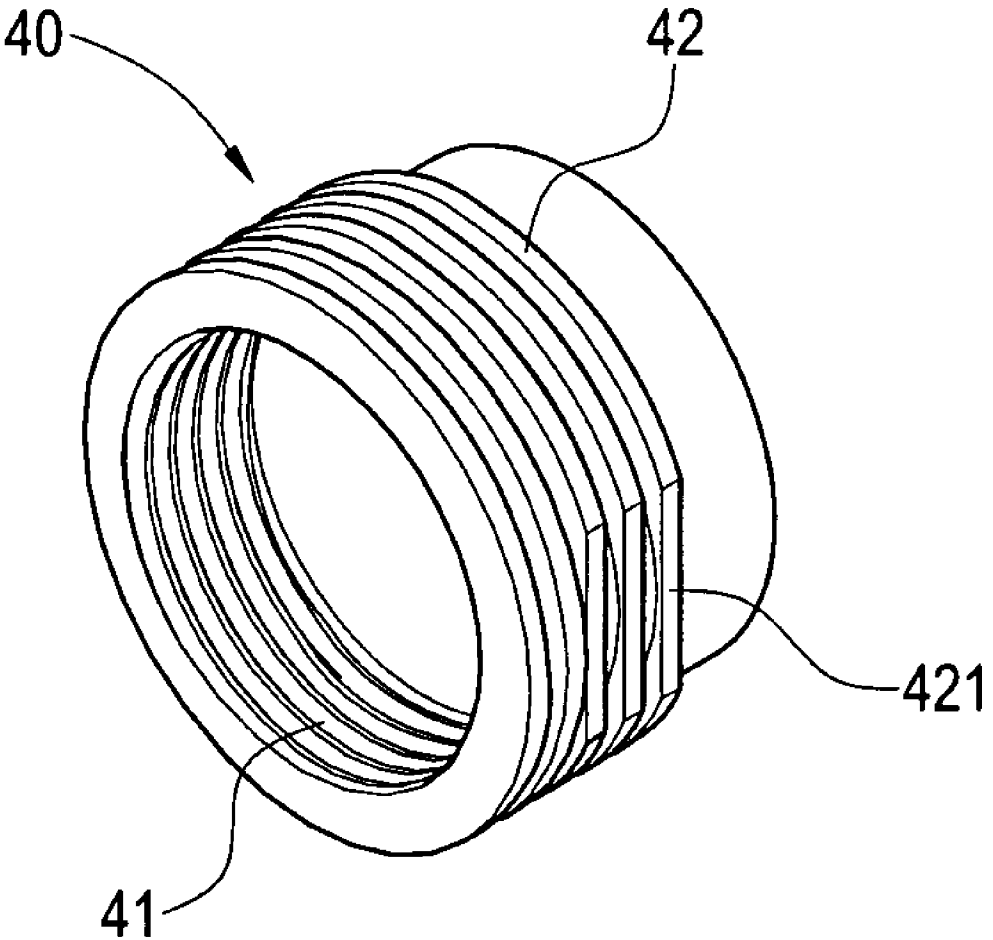
FIG. 8 is a perspective view showing the external appearance of the hollow cylinder of the present invention.

(c) A hollow cylinder 40 is connected to one end of the electrically insulating base 20 and covers the connecting portions between the electrically conductive terminals 10 and the cores 31 (FIG. 5). In this step, the hollow cylinder 40 is a cylindrical body and is formed therein with an second thread 41 engaged with the first thread 211. In the present embodiment, the second thread is an inner thread. The outer periphery of the end of the hollow cylinder 40 adjacent to the second thread 41 is formed with a plurality of positioning rings 42 arranged at intervals. In order to increase the resistance of the hollow cylinder 40 to rotation, the positioning ring 42 is provided thereon with a positioning plane 421 (FIG. 8). In manufacturing, the second thread 41 of the hollow cylinder 40 is engaged with the first thread 211, thereby allowing the hollow cylinder 40 to cover the outside of the connecting portion between each electrically conductive terminal 10 and each core 31.

Figure 6:
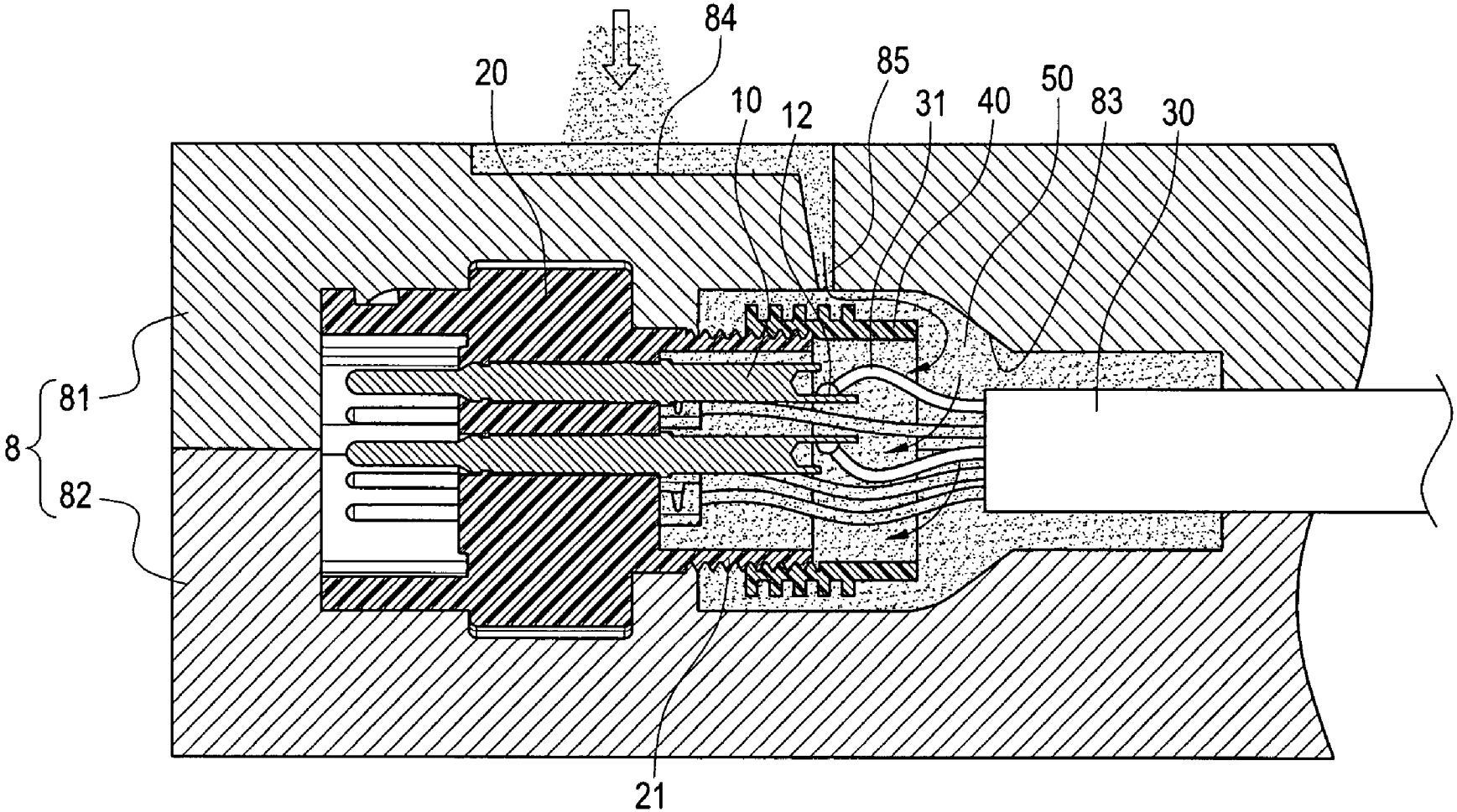
FIG. 6 is a cross-sectional view showing the semi-finished product of the present invention being disposed in the mold and performing a pouring process.

(d) A mold 8 is provided. The semi-finished product made in the steps (a) to (c) is disposed in the mold 8 (FIG. 6). In this step, the mold 8 is made of an upper mold block 81 and a lower mold block 82. The interior of the upper mold block 81 and the lower mold block 82 is formed into a cavity 83. The center of the upper mold block 81 is provided with a pouring channel 84 communicating with the cavity 83. A pouring port 85 is formed between the pouring channel 84 and the cavity 83. The pouring port 85 is exactly located in the middle portion of the hollow cylinder 40. In manufacturing, the semi-finished connector is disposed in the cavity 83 and fixed thereto.

Figure 7:
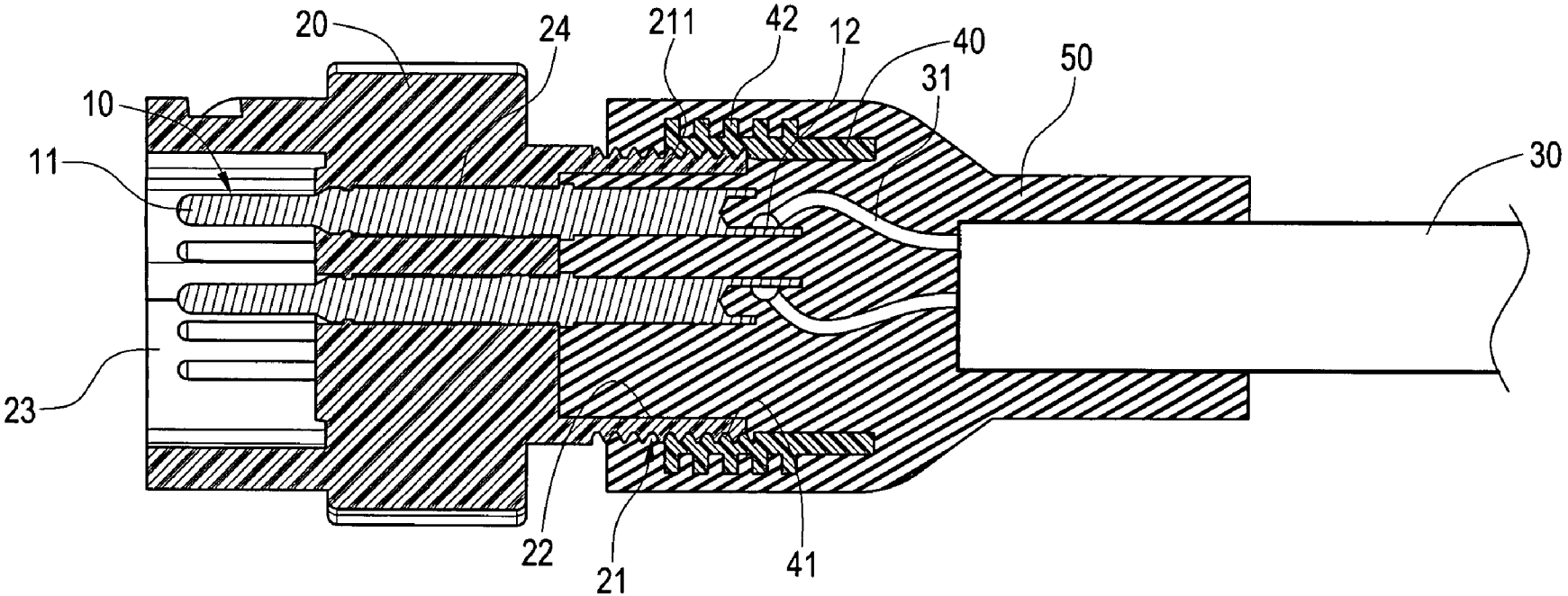
FIG. 7 is a cross-sectional view showing the connector of the present invention.

(e) A molten cladding 50 is injected into the mold 8 and covers the hollow cylinder 40 and the cores 31 and partially covers the electrically insulating base 20, the electrically conductive terminals 10 and the electrical wire 30 (FIG. 6). In this step, the molten fluid such as plastics or rubber is injected from the pouring port 84 of the upper mold block 81 into the cavity 83. The molten fluid is filled in the accommodating trough 22 of the electrically insulating base 20 and the hollow cylinder 40, and covers the connecting end 12 of each electrically conductive terminal 10, the receiving section 21 of the electrically insulating base 20, the hollow cylinder 40, each core 31 and a portion of the electrical wire 30. After the cladding 50 is cooled and solidified, the connector is taken out of the cavity 83 (FIG. 7).

Figure 9:
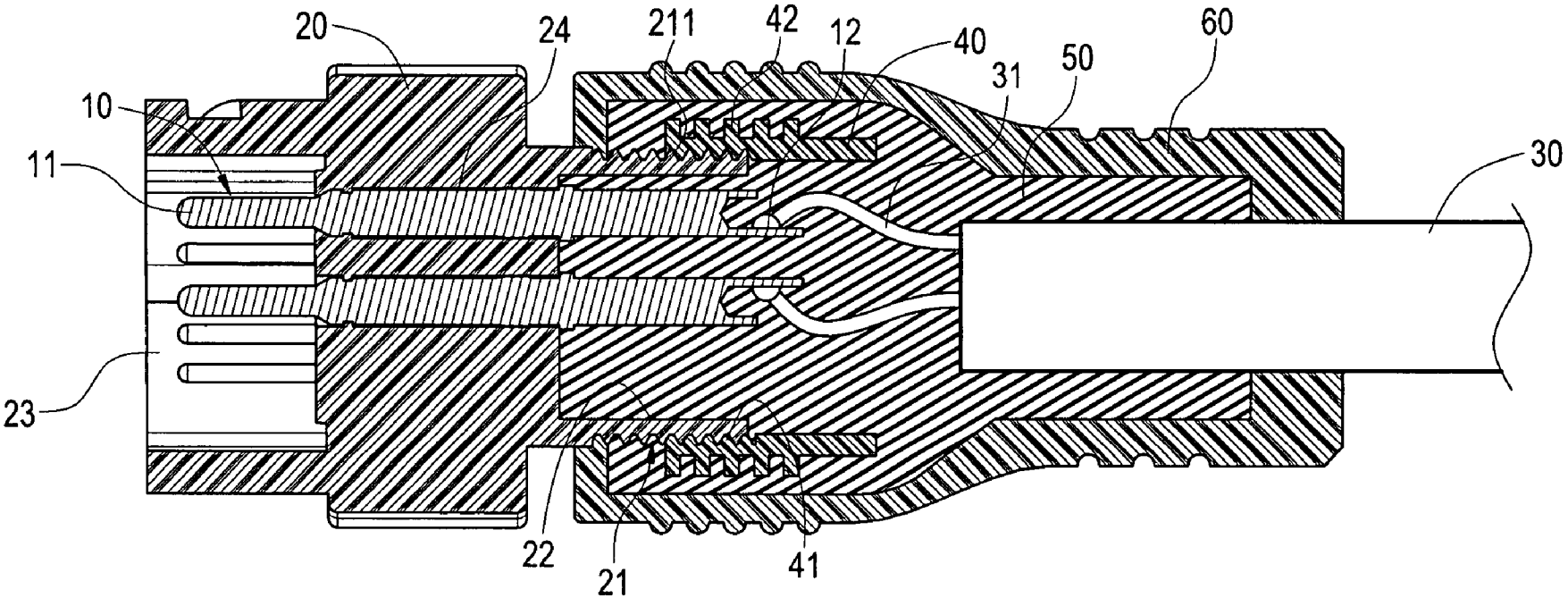
FIG. 9 is a cross-sectional view showing another embodiment of the present invention.
Figure 10:
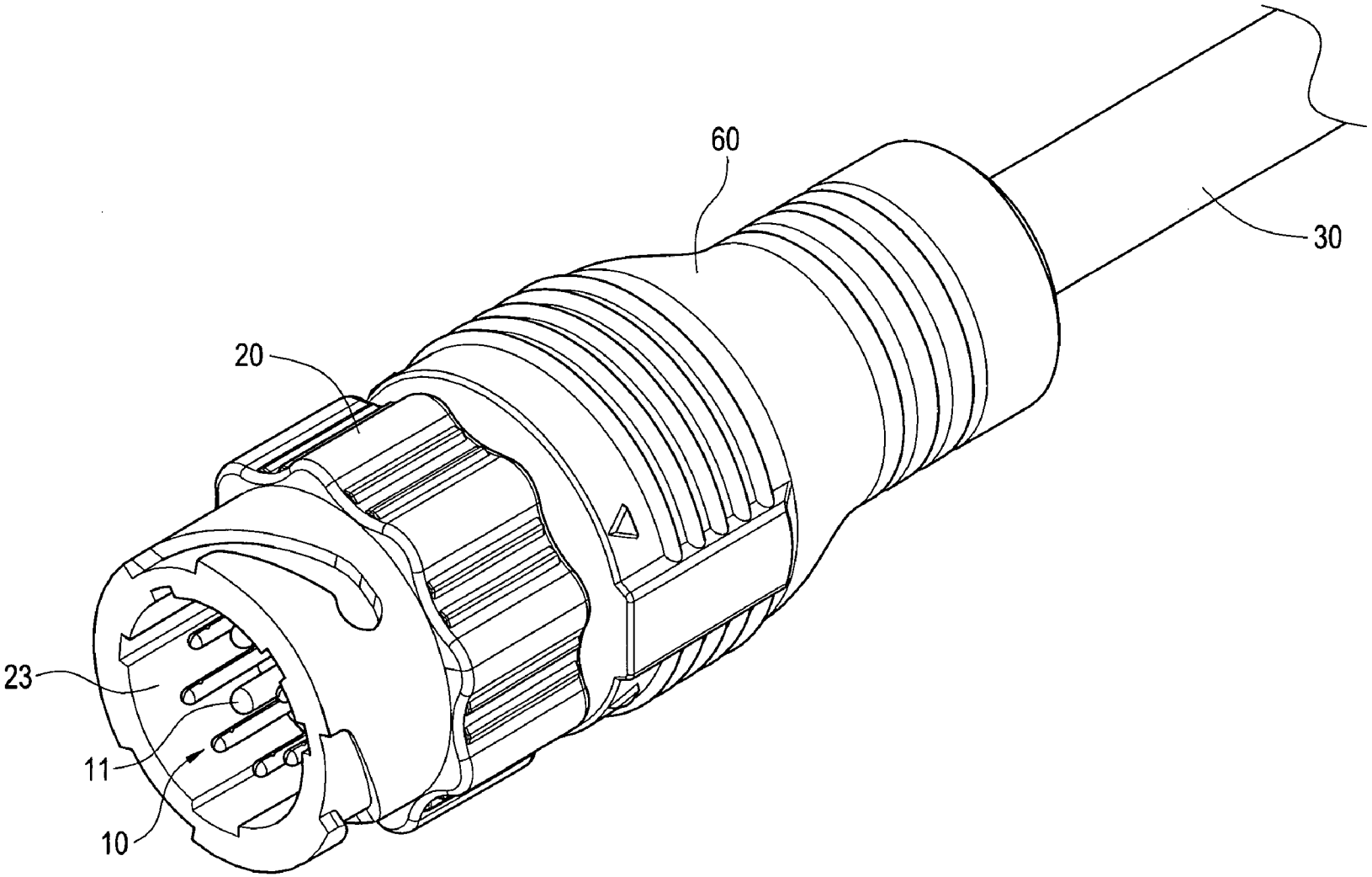
FIG. 10 is a perspective view showing the external appearance of another embodiment of the present invention.

FIG. 9 is a cross-sectional view showing another embodiment of the present invention, and FIG. 10 is a perspective view showing the external appearance of another embodiment of the present invention. The method for manufacturing a waterproof connector of the present invention further includes a step (f) of covering a sheath 60 outside the electrically insulating base 20, the electrical wire 30 and the cladding 50. The step (f) is performed after the step (e). In this step, the connector completed by the step (e) is disposed again in another mold (not shown). The molten material of the sheath 60 is injected in the mold and covers the electrically insulating base 20, the electrical wire 30 and the cladding 50. After the molten sheath 50 is cooled and solidified, the connector can be taken out of the mold (FIG. 10).

Figure 11:
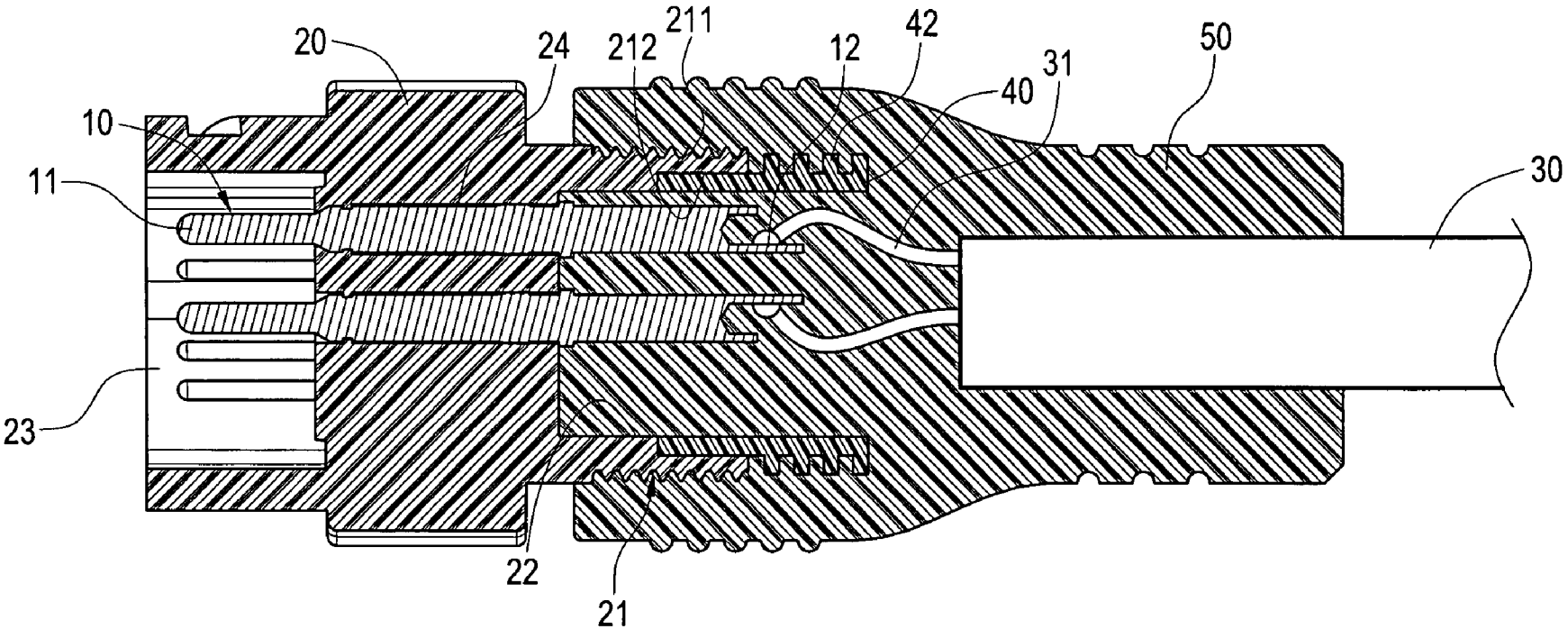
FIG. 11 is a cross-sectional view showing a further embodiment of the present invention.

Please refer to FIG. 11, which is a cross-sectional view showing a further embodiment. The hollow cylinder 40 can be connected with the receiving section 21. In addition, in the present embodiment, the interior of the receiving section 21 is formed with a fixing trough 212. The inner wall of the fixing trough 212 is coated with waterproof adhesive, thereby enhancing the waterproof effect. Then, one end of the hollow cylinder 40 is inserted into the fixing trough 212. Further, the outer surface of the end of the hollow cylinder 40 away from the receiving section 21 is formed with a plurality of positioning rings 42, thereby enhancing the engaging force of the cladding 50 with the hollow cylinder 40 and the electrically insulating base 20 without falling off easily, thereby increasing the waterproof effect in the connector.

Figure 12:
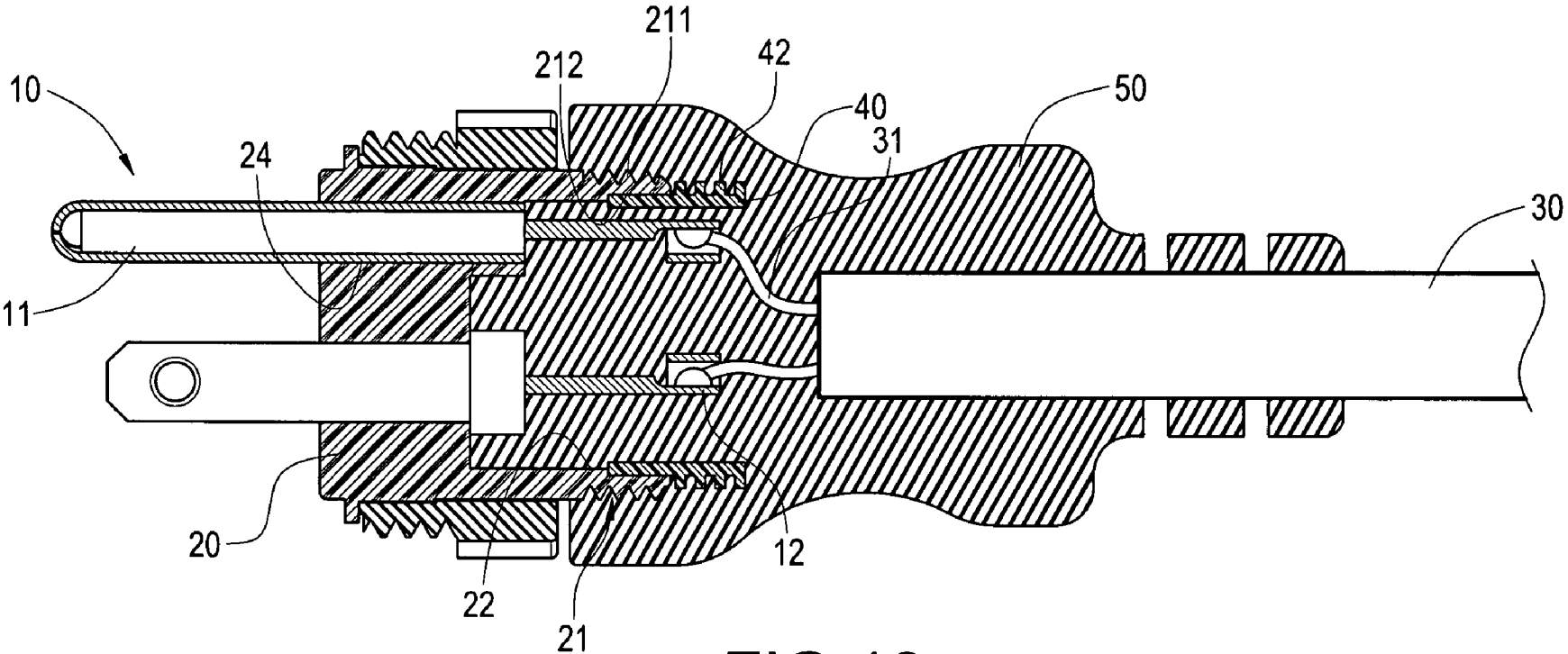
FIG. 12 is a cross-sectional view showing still a further embodiment of the present invention.

Please refer to FIG. 12, which is a cross-sectional view of another embodiment of the present invention. The method and structure of the present invention can be used to an AC waterproof connector. The method for manufacturing this connector is the same as that of the previous embodiment, and thus the description thereof is omitted for clarity. However, in terms of the structure, the interior of the receiving section 21 is formed with an accommodating trough 22. The interior of the electrically insulating base 20 is provided with a plurality of penetrating holes 24 communicating with the accommodating trough 22. The electrically conductive terminal 10 has an insertion end 11 and a connecting end 12 connected to the insertion end 11. The electrically conductive terminals 10 penetrate in the penetrating holes 24 and are fixed therein. The insertion end 11 is exposed to the outside of the electrically insulating base 20, and the connecting end 12 is located in the hollow cylinder 40.

According to the waterproof connector of the present invention and the method for manufacturing the same, the present invention has advantages as follows.

(1) The hollow cylinder is connected with the receiving section of the electrically insulating base tightly. Then, the cladding is injected to cover the electrically insulating base, so that the electrically insulating base and the cladding can be connected with each other firmly. Thus, gaps may not be generated easily and the waterproof effect is increased. In this way, the problem of poor connection because of the large difference between the physical properties of the two materials occurred in manufacturing conventional connectors can be solved efficiently.

(2) The hollow cylinder is used to connect with the receiving section of the electrically insulating base, and is formed outside the connecting end and the electrical wire. Thus, such a structure can prevent the plastic material of the cladding from hitting the connecting end directly during the injection molding process. Therefore, the poor contact between the connecting end and the electrical wire and the possible separation can be avoided. In this way, the yield rate can be increased efficiently.

(3) The hollow cylinder is used to connect with the receiving section of the electrically insulating base, and is formed outside the connecting end and the electrical wire. Thus, such a structure can prevent the plastic material of the cladding from hitting the cores directly during the injection molding process. Therefore, the cores will not be hit by the plastics of the cladding to move and expose the cores outside the cladding, thereby increasing the external appearance of the product.

(4) The hollow cylinder is used to connect with the receiving section of the electrically insulating base, thereby enhancing the structural strength of the waterproof connector and the resistance to shear force and the tension force. Therefore, the waterproof connector can be used for a long time, and even may not snap after bending several times.

(5) The hollow cylinder is used to connect with the receiving section of the electrically insulating base. The hollow cylinder is formed outside the connecting end. When the hollow cylinder is made of a hard material, it can protect the connecting end and the electrical wire efficiently. Thus, the connecting end and the electrical wire inside the hollow cylinder can be prevented from suffering damage when the waterproof connector is bent.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A waterproof connector, comprising:

a plurality of electrically conductive terminals;

an electrically insulating base for allowing the electrically conductive terminals to penetrate and be fixed therein, the electrically insulating base having a receiving section;

an electrical wire having a plurality of cores, the cores being connected to one end of each of the electrically conductive terminals, respectively;

a hollow cylinder connected to the receiving section and located on one side of the electrical wire; and a cladding covering the receiving section, the hollow cylinder, the cores and one end of the electrically conductive terminal.

2. The waterproof connector according to claim 1, wherein the interior of the receiving section is formed with an accommodating trough, one end of the electrically insulating base away from the receiving section is formed with an insertion slot, and the interior of the electrically insulating base is provided with a plurality of penetrating holes communicating with the accommodating trough and the insertion slot.

3. The waterproof connector according to claim 2, wherein the electrically conductive terminal has an insertion end and a connecting end extending from the insertion end, the electrically conductive terminals penetrate in the penetrating holes and are fixed thereto, the insertion end is located in the insertion slot, and the connecting end is located in the hollow cylinder.

4. The waterproof connector according to claim 1, wherein the interior of the receiving section is formed with an accommodating trough, the interior of the electrically insulating base is provided with a plurality of penetrating holes communicating with the accommodating trough, the electrically conductive terminal has an insertion end and a connecting end extending from the insertion end, the electrically conductive terminals penetrate in the penetrating holes and are fixed thereto, the insertion end is exposed to the outside of the electrically insulating base, and the connecting end is located in the hollow cylinder.

5. The waterproof connector according to claim 1, wherein the receiving section has an first thread, an inner surface of the hollow cylinder has an second thread, and the second thread and the first thread are engaged with each other.

6. The waterproof connector according to claim 1, further comprising a sheath, the sheath covering the cladding and partially covering the receiving section and the electrical wire.

7. The waterproof connector according to claim 1, wherein the interior of the receiving section is formed with a fixing slot, and one end of the hollow cylinder penetrates the fixing slot and is fixed therein.

8. The waterproof connector according to claim 1, wherein the outer wall of the hollow cylinder is formed with a positioning ring, and the cladding is connected fixedly to the positioning ring.

9. The waterproof connector according to claim 8, wherein the positioning ring has a positioning plane for positioning the cladding.

* * * * *